US009394891B2

(12) United States Patent
Cuneo

(10) Patent No.: US 9,394,891 B2
(45) Date of Patent: Jul. 19, 2016

(54) VARIABLE DISPLACEMENT LUBRICANT PUMP WITH A PRESSURE CONTROL VALVE HAVING A PRELOAD CONTROL ARRANGEMENT

(75) Inventor: Carmine Cuneo, Leghorn (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 254 days.

(21) Appl. No.: 13/983,576

(22) PCT Filed: Feb. 21, 2011

(86) PCT No.: PCT/EP2011/052490

§ 371 (c)(1),
(2), (4) Date: Sep. 5, 2013

(87) PCT Pub. No.: WO2012/113437

PCT Pub. Date: Aug. 30, 2012

(65) Prior Publication Data

US 2014/0030120 A1 Jan. 30, 2014

(51) Int. Cl.

| | |
|---|---|
| ***F04B 17/05*** | (2006.01) |
| ***F04C 2/344*** | (2006.01) |
| ***F04C 14/22*** | (2006.01) |
| *F04B 27/18* | (2006.01) |

(52) U.S. Cl.

CPC ..... *F04B 17/05* (2013.01); *F04B 27/1804* (2013.01); *F04C 2/3442* (2013.01); *F04C 14/223* (2013.01); *F04B 2027/1827* (2013.01); *F04C 2210/206* (2013.01); *F04C 2270/185* (2013.01)

(58) Field of Classification Search

CPC .. F04C 2/3442; F04C 14/223; F04C 2270/18; F04B 27/1804; F04B 2027/1827; F04B 2027/1859; F04B 2027/1877

See application file for complete search history.

(56) References Cited

U.S. PATENT DOCUMENTS

| | | | |
|---|---|---|---|
| 2,740,256 | A | 4/1956 | O'Malley |
| 4,292,805 | A | 10/1981 | Acheson |
| 4,632,638 | A | 12/1986 | Shibayama et al. |
| 2005/0129528 | A1 | 6/2005 | Hunter et al. |
| 2008/0038117 | A1 | 2/2008 | Armenio et al. |

(Continued)

FOREIGN PATENT DOCUMENTS

| | | | |
|---|---|---|---|
| CN | 101379296 | A | 3/2009 |
| DE | 10 2008 048 856 | A1 | 4/2010 |

(Continued)

*Primary Examiner* — Patrick Hamo
(74) *Attorney, Agent, or Firm* — Norman B. Thot

(57) ABSTRACT

A lubricant pump for pumping a pressurized lubricant to an engine includes a shiftable control ring, a pump rotor, a pump outlet port, a pressure control system and a preload control arrangement. The pressure control system comprises a first pressure control chamber, a first pressure conduit connecting the pump outlet port with the first pressure control chamber, and a pressure control valve. The pressure control valve comprises an outlet port, a control valve cylinder wall comprising a control port connected with the outlet port, a control plunger which opens and closes the control port, an input pressure plunger connected with the control plunger, and a control spring preloading the control plunger into a closed position. The preload control arrangement comprises a preload cylinder, a preload plunger in the preload cylinder supporting a basis of the control spring, a preload cylinder inlet, and a preload control valve controlling a lubricant pressure.

7 Claims, 2 Drawing Sheets

(56) References Cited

U.S. PATENT DOCUMENTS

| | | | |
|---|---|---|---|
| 2008/0289338 | A1 | 11/2008 | Desai |
| 2010/0221126 | A1 | 9/2010 | Tanasuca et al. |

FOREIGN PATENT DOCUMENTS

| | | | |
|---|---|---|---|
| JP | 10-67332 | A | 3/1998 |
| JP | 2005-133716 | A | 5/2005 |
| WO | WO 2005/026553 | A1 | 3/2005 |
| WO | WO 2007/044020 | A2 | 4/2007 |

VARIABLE DISPLACEMENT LUBRICANT PUMP WITH A PRESSURE CONTROL VALVE HAVING A PRELOAD CONTROL ARRANGEMENT

CROSS REFERENCE TO PRIOR APPLICATIONS

This application is a U.S. National Phase application under 35 U.S.C. §371 of International Application No. PCT/EP2011/052490, filed on Feb. 21, 2011. The International Application was published in English on Aug. 30, 2012 as WO 2012/113437 A1 under PCT Article 21(2).

FIELD

The present invention relates to a variable displacement lubricant pump for providing pressurized lubricant for an internal combustion engine.

BACKGROUND

The mechanical pump comprises a pump rotor with radially slidable vanes rotating in a radially shiftable control ring, whereby the control ring is pushed by a first control chamber into high pumping volume direction. The pump comprises a pressure control system for controlling the discharge pressure of the pressurized lubricant at the pump outlet port. The pump is provided with a first pressure conduit which connects the pump outlet port with the first control chamber. The pump is also provided with a pressure control valve which controls the pressure in the first pressure control chamber.

A variable displacement lubricant pump is described in WO 2005/026553 A1. The pressure control valve keeps the pressure of the pressurized lubricant provided by the pump at a more or less constant level independent of the rotational speed of the pump rotor. This is realized by opening and closing a pressure control port of the control valve, whereby the pressure control chamber of the pump is connected or disconnected to the atmospheric pressure in the lubricant tank. The lubricant pressure demand of the engine is not constant, however, but depends on some working conditions of the engine, for example, on the lubricant temperature and on the rotational speed of the engine.

SUMMARY

An aspect of the present invention is to provide a variable displacement lubricant pump with a simple control system which provides two levels of nominal pressure of the pressurized lubricant leaving the pump.

In an embodiment, the present invention provides a variable displacement lubricant pump configured to be coupled to and driven by an internal combustion engine for pumping a pressurized lubricant to the internal combustion engine which includes a control ring configured to be shiftable, a pump rotor comprising vanes configured to be radially slidable and to rotate in the control ring, a pump outlet port, a pressure control system configured to control a discharge pressure of the pressurized lubricant, and a preload control arrangement configured to control a preload of the control spring. The pressure control system comprises a first pressure control chamber configured to push the control ring into a high pumping volume direction, a first pressure conduit configured to connect the pump outlet port with the first pressure control chamber, and a pressure control valve configured to control a pressure in the first pressure control chamber. The pressure control valve comprises an outlet port, a control valve cylinder wall in which a control port is arranged, the control port being connected with the outlet port, a control plunger configured to open and close the control port, an input pressure plunger connected with the control plunger and configured to be charged with a pump outlet pressure, and a control spring configured to preload the control plunger into a closed position against the pump outlet pressure. The preload control arrangement comprises a preload cylinder, a preload plunger configured to axially move in the preload cylinder and to support a basis of the control spring, a preload cylinder inlet configured to provide the pressurized lubricant into the preload cylinder, and a preload control valve configured to control a lubricant pressure in the preload cylinder.

BRIEF DESCRIPTION OF THE DRAWINGS

The present invention is described in greater detail below on the basis of embodiments and of the drawings in which.

DETAILED DESCRIPTION

Figure 1:
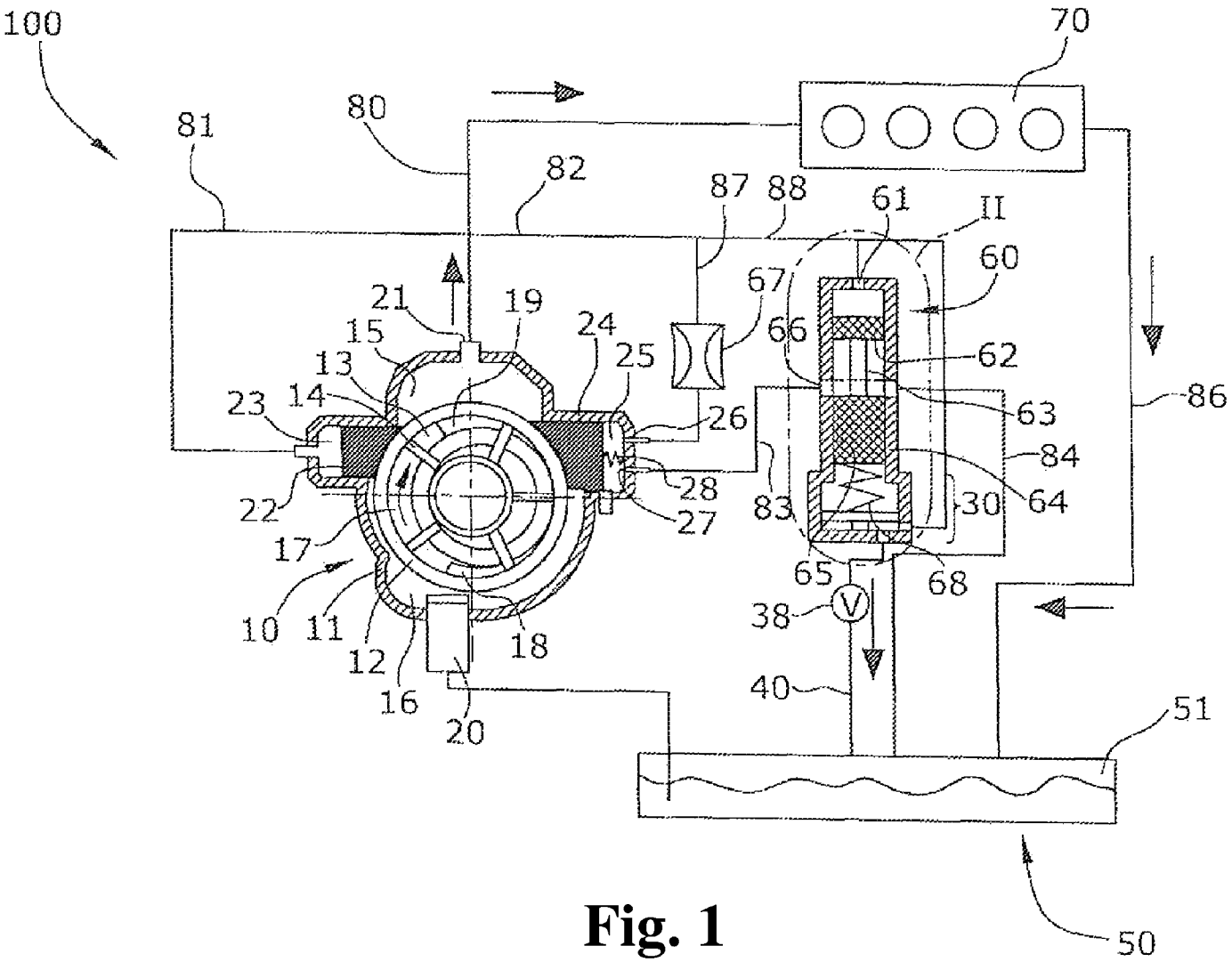
FIG. 1 shows a lubricant pumping system including a variable displacement vane pump and a control valve.

The variable displacement lubricant pump is provided with a pump rotor with radially slidable vanes rotating in a shiftable control ring. The pump is provided with a first pressure control chamber for pushing the control ring into a high pumping volume direction. The first pressure control chamber is connected to the pump outlet port by the first pressure conduit. The pressure control valve for controlling the pressure in the first pressure control chamber comprises a control plunger, an input pressure plunger and a control spring. The control plunger opens and closes a control port in a cylinder wall of the control valve. The control port is connected with an outlet port of the control chamber.

When the control plunger blocks and closes the control port, the pressure in the first pressure control chamber increases so that the control ring is pushed into high pumping volume direction. When the control plunger does not close the control port of the pressure control valve, the pressure in the first pressure control chamber decreases to more or less atmospheric pressure so that the control ring can move into a low pumping volume direction.

The position of the control plunger is determined by the lubricant discharge pressure of the pump which is directed to an input pressure plunger which is charged with the pump outlet pressure. The input pressure plunger is directly connected with the control plunger. A control spring is provided which preloads the control plunger into a closed position against the pump outlet pressure charging the input pressure plunger. The spring force of the control spring and the pump outlet pressure acting on the input pressure plunger force the control plunger into an equilibrium position.

The pump is provided with a preload control arrangement for controlling the preload of the control spring. The preload control arrangement comprises a preload plunger, a preload cylinder inlet and the preload control valve. The preload plunger moves axially in the preload cylinder and supports the basis of the control spring so that the spring pretension of the control plunger can be varied between two values. The preload plunger is axially arranged in the preload cylinder, whereby the cylinder is provided with pressurized lubricant which can be the pressurized lubricant of the pump outlet port. The preload control valve can charge the preload cylinder with the pressure of the pressurized lubricant so that the preload plunger is moved into a high preload position which is also a high nominal pressure position. The preload control valve can alternatively provide a more or less atmospheric pressure in the preload cylinder so that the preload plunger moves into and maintains a low preload position which is the low nominal pressure position.

The concept and the construction of this preload control arrangement is simple, and provides for a high reliability and a long mechanical life.

The preload control valve can in principal be provided between the pump outlet port and the preload cylinder inlet, whereby the preload cylinder outlet is connected to atmospheric pressure via a throttle valve. The preload cylinder outlet can, for example, be connected to the lubricant tank by a preload control discharge conduit, whereby the preload control valve is provided in line with the preload control discharge conduit so that the preload control valve is provided between the preload cylinder outlet and atmospheric pressure. A throttle valve can, for example, be provided in line with the preload control charge conduit which connects the pump outlet port with the preload cylinder inlet.

In an embodiment of the present invention, the control valve cylinder wall and the preload cylinder can, for example, be part of one single integrated valve housing. This makes the production and assembling of the pump, and in particular of the pressure control valve including the preload control arrangement, simple and cost effective.

In an embodiment of the present invention, a ventilation port can, for example, be provided in the valve housing axially between the control plunger and the preload plunger. The ventilation port is arranged in a position outside the movement range of the control plunger and the preload plunger so that the ventilation port is never blocked or closed by said plungers. The ventilation port allows a variation of the cavity between the control plunger, the preload plunger and the valve housing. The ventilation port can, for example, be connected to the lubricant tank.

In an embodiment of the present invention, the axial distal side of the preload plunger can, for example, be provided with an offset nose for always keeping the preload plunger at a minimum distance from the preload cylinder front end wall. This arrangement avoids a direct contact of the plane front end of the preload plunger with the plane cylinder front end wall. Since the preload cylinder outlet can, for example, be provided in the cylinder front end wall, the offset nose of the preload plunger avoids a blocking of the preload cylinder outlet.

In an embodiment of the present invention, the preload plunger can, for example, be provided with a spring guide sleeve at the proximal side of the preload plunger. The basis of the control spring is radially supported by the spring guide sleeve so that slipping of the control spring basis at the preload plunger is avoided.

In an embodiment of the present invention, the preload cylinder can, for example, be larger in diameter than the control valve cylinder wall, the step between them defining a stop ring for the preload plunger.

The following is a detailed description of an embodiment of the present invention with reference to the drawings.

FIG. 1 shows a schematic representation of a variable displacement lubricant pump 10 as a part of a pumping system 100 for supplying an internal combustion engine 70 with pressurized lubricant. The pump 10 is mechanically directly driven by the engine 70 and comprises a pump housing 11 having a cavity 16 in which a radially shiftable control ring 12 translates.

The control ring 12 encircles a pump rotor 13 which is provided with numerous radially slidable vanes 14, whereby the vanes 14 rotate inside the control ring 12. The pump housing 11 is closed by two pump side walls 15 of which one is not shown in the drawing. The pump side walls 15, the vanes 14, the pump rotor 13 and the control ring 12 define five rotating pump chambers 17. One of the side walls 15 is provided with a pump chamber inlet opening 18 and with a pump chamber outlet opening 19.

The control ring 12 is provided with a first control ring plunger 24 housed in part in a first pressure control chamber 25 and is provided with a second control ring plunger 22 housed in part in a second control chamber 23 opposite the first pressure control chamber 25. The plungers 22, 24 are prismatic in cross section. The control ring 12 and the plungers 22, 24 are one single integral part.

A pretensioned control chamber spring 28 inside the first pressure control chamber 25 exerts a pushing force to the first plunger 24. Both control chambers 25, 23 are defined by the pump housing 11. The pump housing 11 also comprises a pump inlet port 20 for sucking the lubricant from a lubricant tank 50 and a pump outlet port 21 for feeding lubricant with a discharge pressure to the engine 70. An engine supply conduit 80 extends from the pump outlet port 21 to the engine 70 to supply the engine 70 with pressurized lubricant. A return conduit 86 leads from the engine 70 to the lubricant tank 50.

The lubricant discharge pressure at the pump outlet port 21 is transmitted to the second control chamber 23 via a pressure conduit 81. The lubricant leaving the pump outlet port 21 is additionally conducted, via inlet port 26, to the first pressure control chamber 25 via conduits 82,87 and through a pressure throttle valve 67 in which a calibrated pressure drop occurs as the lubricant flows through.

The pump outlet port 21 is also connected to an input pressure port 61 of a pressure control valve 60 by a conduit 82,88. The pressure control valve 60 keeps the outlet pressure at the pump outlet port 21 at a constant nominal pressure value independently of the rotational speed of the engine 70 by regulating the radial position of the control ring 12. The radial position of the control ring 12 is controlled by controlling the pressure in the first pressure control chamber 25.

The pressure control valve 60 is able to control two different nominal pressure values by changing the position of a preload plunger 42 serving as a basis for a control spring 68. The pressure control valve 60 is provided with a single integral valve housing 90 which comprises two different functional parts, i.e., a pressure control arrangement 94 and the preload control arrangement 30. The valve housing 90 is provided with two different cylindrical parts of different diameters: the pressure control cylinder wall 65 with a low diameter housing the pressure control arrangement 94, and the preload cylinder 31 with a higher diameter housing the preload plunger 42. The transition between the preload cylinder 31 and the pressure control cylinder wall 65 is realized by a circular stop ring 41 with a radial ring-like surface.

The pressure control arrangement 94 inside the pressure control cylinder wall 65 is one integral part which is axially shiftable and which consists of an input pressure plunger 62, a control plunger 64 and a plunger shaft 63 connecting the input pressure plunger 62 and the control plunger 64. The input pressure plunger 62 is charged with the pump discharge pressure via the input pressure port 61. The pump discharge pressure pushing the input pressure plunger 62 acts against the spring force of the control spring 68 axially pushing the control plunger 64.

The pressure control arrangement 94 controls the discharge of the first pressure control chamber 25 via conduit 83 by closing and opening a control port 66 in the pressure control cylinder wall 65. The control plunger 64 closes the control port 66 in a closing position and opens the control port 66 in the open position. In an open position of the control plunger 64, the lubricant of the first pressure control chamber 25 can be discharged via outlet port 27, conduit 83, the control port 66, a control valve discharge port 97 and a discharge conduit 84 to the lubricant tank 50.

The basis of the control spring 68 is supported by the preload plunger 42 which is axially shiftable within the preload cylinder 31. The preload plunger 42 can be switched between two axial positions, i.e., a high discharge pressure position in which the control spring 68 is compressed, and a discharge pressure position in which the control spring 68 is expanded.

The preload plunger 42 is provided with a cylindrical plunger body 44 which is provided with an offset nose 45 at the distal axial side and with a cylindrical spring guide sleeve 43 at the proximal side of the plunger body 44. The offset nose 45 provides a minimum distance of the plunger body 44 with respect to the front end wall 92 of the preload cylinder 31. This minimum distance provides that the inlet 34 and the outlet 36 can never be blocked or closed by the plunger body 44. The cylindrical spring guide sleeve 43 centers the basis of the control spring 68 at the plunger body 44 so that the control spring 68 can not be jammed between the preload plunger 42 and the stop ring 41. The outer diameter of the spring guide sleeve 43 is less than the inner diameter of the pressure control cylinder wall 65. The axial movement of the preload plunger 42 is restricted by the front end wall 92 at one side and by the stop ring 41 at the other side.

Figure 2:
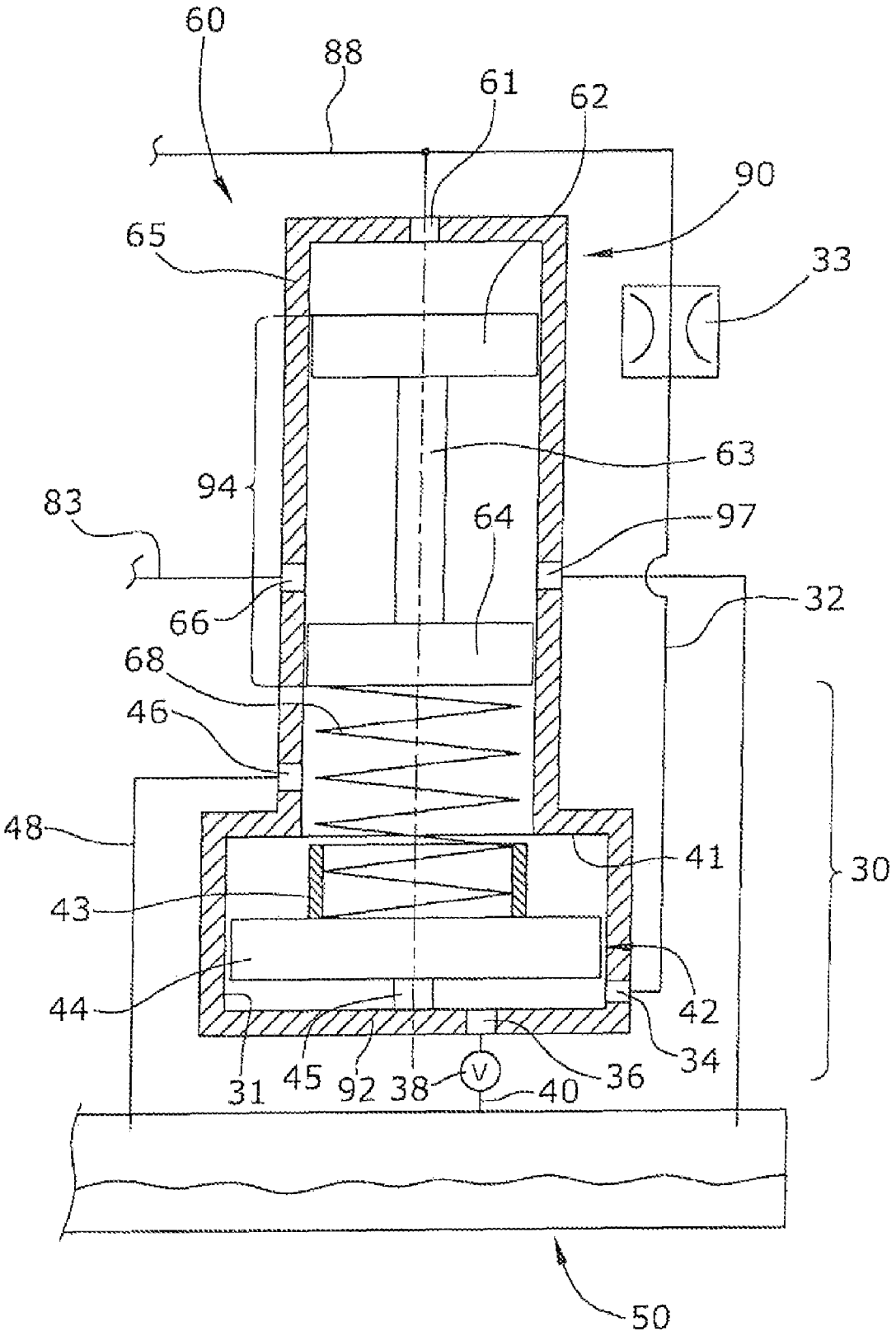
FIG. 2 shows the control valve of FIG. 1 in a detailed longitudinal section.

The preload cylinder outlet 36 is connected to the lubricant tank 50 by a preload control discharge conduit 40, whereby the preload control valve 38 is provided in line with the preload control discharge conduit 40 so that the preload control valve 38 is provided between the preload cylinder outlet 36 and atmospheric pressure 51. The preload cylinder inlet 34 is connected to the pump outlet port 21 via a preload control charge conduit 32, whereby the throttle valve 33 is provided in line with the preload control charge conduit 32. When the preload control valve 38 is closed, the lubricant with the pump discharge pressure pushes the preload plunger 42 up into the high discharge pressure position. When the preload control valve 38 is open, the lubricant inside the preload cylinder 31 is discharged to the lubricant tank 50 so that the preload plunger 42 moves into a low discharge pressure position as shown in FIG. 2. The preload control valve 38 is a solenoid valve and is controlled by a digital engine control unit (not shown) which adapts the nominal discharge pressure dependent on, for example, the lubricant temperature, the engine temperature etc.

The pressure control cylinder wall 65 is provided with a ventilation port 46 which is connected via a ventilation conduit 48 with the lubricant tank 50 so that the pressure in the cavity between the control plunger 64 and the preload plunger 42 is always at a more or less atmospheric pressure.

The present invention is not limited to embodiments described herein; reference should be had to the appended claims.

What is claimed is:

1. A variable displacement lubricant pump configured to be coupled to and driven by an internal combustion engine for pumping a pressurized lubricant to the internal combustion engine, the variable displacement lubricant pump comprising:

a control ring configured to be shiftable;

a pump rotor comprising vanes configured to be radially slidable and to rotate in the control ring;

a pump outlet port;

a pressure control system configured to control a discharge pressure of the pressurized lubricant, the pressure control system comprising:

a first pressure control chamber configured to push the control ring into a high pumping volume direction;

a first pressure conduit configured to connect the pump outlet port with the first pressure control chamber; and a pressure control valve configured to control a pressure in the first pressure control chamber, the pressure control valve comprising:

an outlet port;

a control valve cylinder wall in which a control port is arranged, the control port being connected with the outlet port;

a control plunger configured to open and close the control port;

an input pressure plunger connected with the control plunger and configured to be charged with a pump outlet pressure; and a control spring configured to preload the control plunger into a closed position against the pump outlet pressure;

a preload control arrangement configured to control a preload of the control spring, the preload control arrangement comprising:

a preload cylinder;

a preload plunger configured to axially move in the preload cylinder and to support a basis of the control spring;

a preload cylinder inlet configured to provide the pressurized lubricant into the preload cylinder; and a preload control valve configured to control a lubricant pressure in the preload cylinder;

a preload cylinder outlet;

a lubricant tank; and a preload control discharge conduit, wherein, the preload cylinder outlet is connected to the lubricant tank via the preload control discharge conduit, and the preload control valve is arranged so as to be in line with the preload control discharge conduit.

2. The variable displacement lubricant pump as recited in claim 1, wherein the preload cylinder comprises a preload cylinder front end wall in which the preload cylinder outlet is arranged, and the preload plunger comprises a distal side which comprises an offset nose, the offset nose being configured to maintain the preload plunger at a minimum distance from the preload cylinder front end wall.

3. The variable displacement lubricant pump as recited in claim 1, further comprising a preload control charge conduit arranged between the pump outlet port and the preload cylinder inlet, and a throttle valve arranged so as to be in line with the preload control charge conduit.

4. The variable displacement lubricant pump as recited in claim 1, whereby the control valve cylinder wall and the preload cylinder are parts of a single integral valve housing.

5. The variable displacement lubricant pump as recited in claim 4, further comprising a ventilation port arranged in the single integral valve housing between the control plunger and the preload plunger.

6. The variable displacement lubricant pump as recited in claim 1, wherein the preload plunger comprises a promixal side which comprises a spring guide sleeve.

7. The variable displacement lubricant pump as recited in claim 1, wherein the preload cylinder has a diameter which is larger than a diameter of the control valve cylinder wall, and a step between the preload cylinder and the control valve cylinder wall defines a stop ring for the preload plunger.

* * * * *